US006362407B1

(12) United States Patent
Dennis et al.

(10) Patent No.: US 6,362,407 B1
(45) Date of Patent: Mar. 26, 2002

(54) DRUM PRACTICE PADS AND DRUM PAD MUSICAL INSTRUMENTS

(76) Inventors: Denny R. Dennis, 12621 Edieth Dr., Garden Grove, CA (US) 92841; Marcel R. Daignault, 823 S. Westvale Dr., Anaheim, CA (US) 92804

( * ) Notice: Subject to any disclaimer, the term of this patent is extended or adjusted under 35 U.S.C. 154(b) by 0 days.

(21) Appl. No.: 09/560,014

(22) Filed: Apr. 27, 2000

(51) Int. Cl.[7] ..... G10D 13/02
(52) U.S. Cl. ..... 84/411 P; 84/411 R; 84/411 M
(58) Field of Search ..... 84/411 P, 411 R, 84/411 M

(56) References Cited

U.S. PATENT DOCUMENTS 2,722,860 A * 11/1955 Pace ..... 84/411 R
3,264,926 A * 8/1966 Belli ..... 84/411 R
3,326,074 A * 6/1967 Osty et al. ..... 84/411 R
3,597,520 A * 8/1971 Andrews ..... 84/411 R
3,998,123 A * 12/1976 Hinges ..... 84/422.4
4,406,207 A * 9/1983 Cruscione ..... 84/411 P
5,105,711 A * 4/1992 Barnard ..... 84/744
5,170,001 A * 12/1992 Amendola ..... 84/422.4
5,520,090 A * 5/1996 Eagle ..... 84/411 P
5,929,354 A * 7/1999 Davis ..... 84/411 P

* cited by examiner

*Primary Examiner*—Shih-Yung Hsieh
(74) *Attorney, Agent, or Firm*—Richard E. Bee

(57) ABSTRACT

A drum practice pad comprised of a flat circular piece of hard material having a flat circular piece of resilient material bonded to the upper surface thereof, the piece of resilient material having a diameter which is less than the diameter of the piece of hard material. Sound insulating cushions are affixed to the lower surface of the hard material for supporting the hard material in an acoustically-floating manner during use. A plural-pitch set of drum pads is provided by using a second drum pad of this same construction, but with the piece of hard material having a different thickness or diameter.

25 Claims, 4 Drawing Sheets

DRUM PRACTICE PADS AND DRUM PAD MUSICAL INSTRUMENTS

TECHNICAL FIELD

This invention relates to drum practice pads of the type used by drummers when warming up or practicing for a performance. Such practice pads are useful in hotel rooms, class rooms and other locations where it is desired to minimize the noise level.

BACKGROUND OF THE INVENTION

It frequently happens that a drum player would like to warm up or practice in a location where loud noises are objectionable. One example would be a hotel room where the drummer is spending the night before a performance. Another example would be a home location at a time of night when neighbors would be likely to complain. A further example would be a school music room where several students are taking drum lessons at the same time. In such cases, it would be desirable for the drummer to practice without making the usual rather loud drum sounds.

A known solution is to use a rubber pad glued to a piece of particle board as a drum practice pad. The drummer goes through his routine by hitting his drum sticks on one or more of these rubber pads, in place of real drums. This solves the noise problem, but the results are not very satisfactory. The rubber pad and particle board doesn't feel like a real drum and doesn't produce a very satisfying or meaningful sound. In particular, the particle board is acoustically dead and had no tonal quality. Also, if two or more of these pads are used to simulate two or more different drums, all of the pads sound pretty much the same and it is next to impossible to hear any sort of musical pattern. Consequently, there is a considerable need for an improved drum practice pad having a more realistic feel and producing a more pleasing sound.

SUMMARY OF THE INVENTION

The present invention provides a new and improved drum practice pad of relatively simple construction which produces a pleasing but not overly loud sound. In a representative embodiment, this improved drum practice pad is comprised of a flat circular piece of hard material having a flat circular piece of resilient material bonded to the upper surface of the hard material. Sound insulating cushions are affixed to the lower surface of the hard material for supporting the hard material in an acoustically-floating manner during use. In use, the drum player strikes his drum sticks on the resilient material in the same manner as he would against the playing surface of a drum. In a preferred embodiment, the hard material is wood and the resilient material is rubber.

A further feature of the present invention is that a plural-pitch or multiple-pitch set of drum pads can be provided for simulating two or more different drums. Different pitches are produced by using different thicknesses and/or different size diameters for the wood or other hard material. With different pitches, recognizable musical patterns can be produced. As such, this combination provides a plural-pitch drum-like musical instrument for playing musical rhythmic patterns.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings:

FIG. 4 is a side view of the drum practice pad of FIG. 1, as modified for use on a table top or the like;

DETAILED DESCRIPTION OF THE ILLUSTRATED EMBODIMENTS

Figure 1:
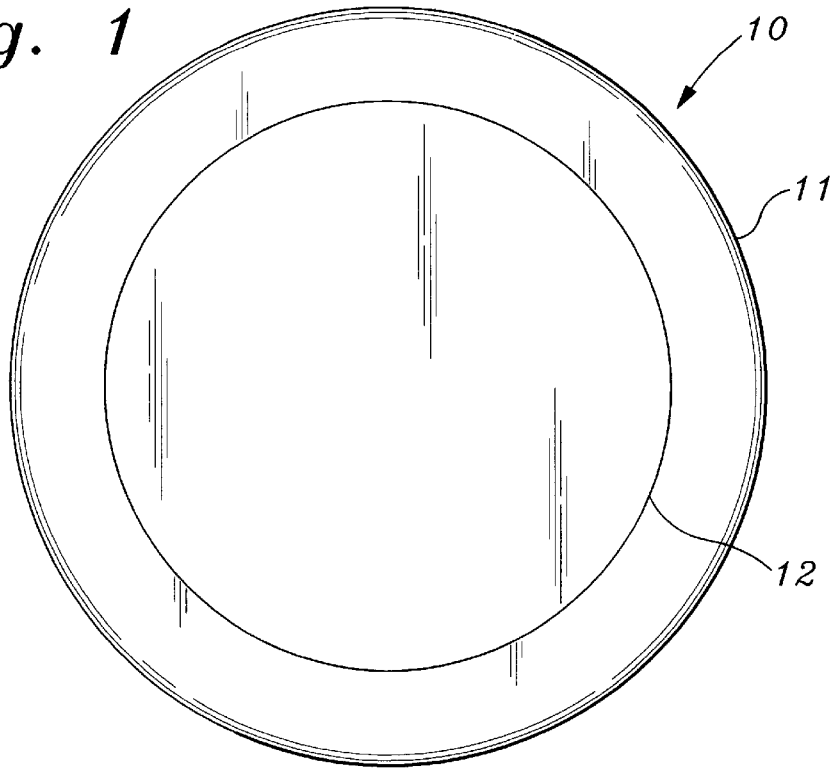
FIG. 1 is a top view of a drum practice pad constructed in accordance with the present invention.
Figure 2:
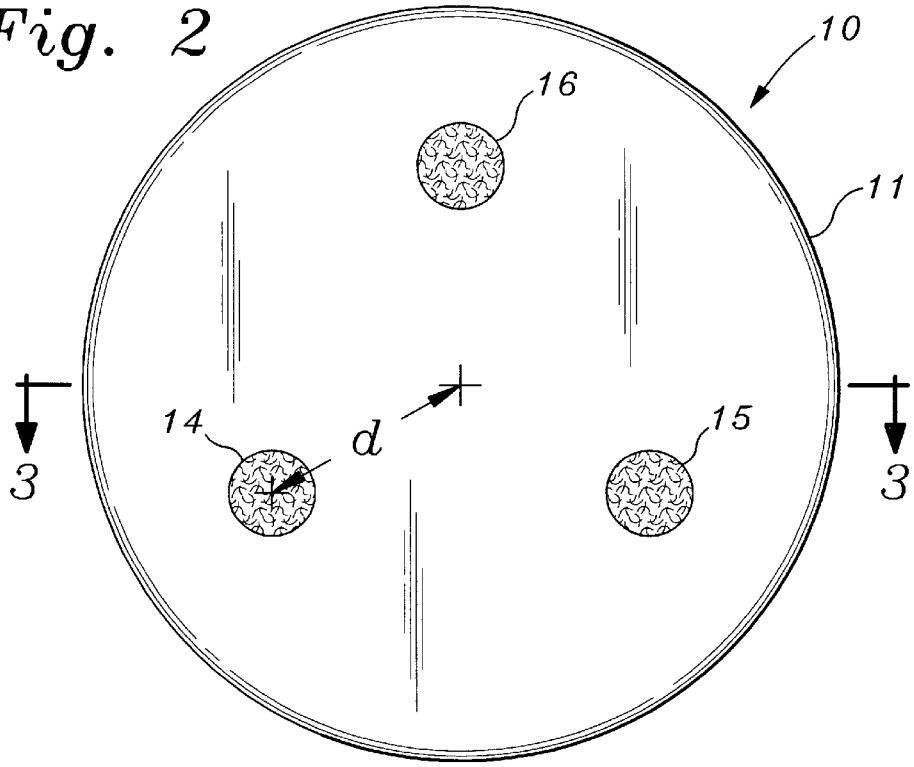
FIG. 2 is a bottom view of the drum practice pad of FIG. 1.
Figure 3:
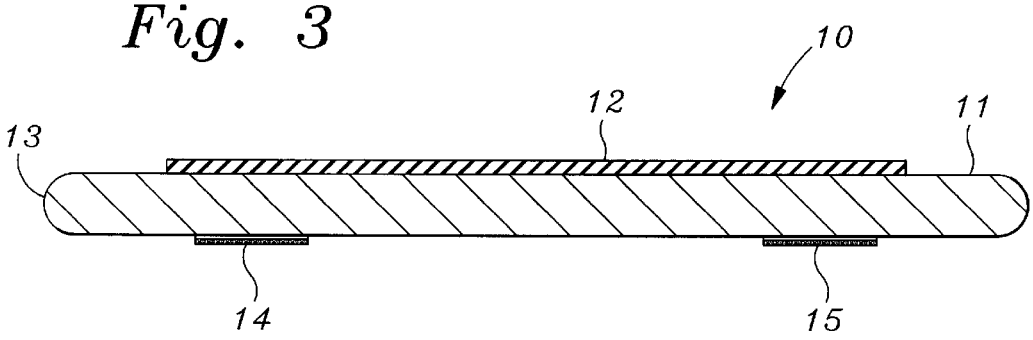
FIG. 3 is a cross-sectional view of the drum practice pad of FIG. 1 taken along section line 3—3 of FIG. 2.

Referring to FIGS. 1–3, there is shown a representative embodiment of an improved drum practice pad 10 constructed in accordance with the present invention. The drum pad 10 includes a flat circular piece of hard material 11 having a flat circular piece of resilient material 12 affixed to the upper surface of the hard material 11. As seen in the top view of FIG. 1, the resilient material 12 has a diameter which is less than the diameter of the hard material 11.

The piece of hard material 11 should be an acoustically-solid piece of hard material which produces a definite and recognizable tonal sound when struck by a drum stick. In particular, it must be a non-acoustically-damping piece of hard material.

In a preferred embodiment, the hard material 11 is wood and the resilient material 12 is rubber. The rubber material 12 is bonded to the upper surface of the wood 11 by means of an appropriate glue, such as a spray-on type glue, which is applied to the underside of the rubber piece 12. The piece of wood 11 is sanded and coated with an appropriate paint or lacquer before the rubber material 12 is applied. As shown in FIG. 3, the side or perimeter 13 of the piece of wood 11 is rounded to provide a pleasing appearance.

For most applications, the piece of wood 11 should have a diameter in the range of eight to sixteen inches and a thickness in the range of one-quarter inch to one inch. The piece of wood 11 may be either a solid piece of natural wood or a piece of laminated wood. If laminated wood is used, each lamination or layer must be natural wood. Particle board or fiber board material must not be used because it has been found to deaden the desired sound. If laminated wood is used, the number of laminations or layers should be in the range of five to fifteen. Maple wood has been found to provide excellent sound qualities. A highly suitable type of laminated maple wood is sold under the trade name of "Appleply".

The flat circular piece of resilient material 12 is centrally positioned on the upper surface of the flat circular piece of hard material 11 and should have a diameter in the range of seventy to eighty-five percent of the diameter of the piece of hard material 11. Typically, the diameter of the resilient material 12 will be on the order of two to three inches less than the diameter of the hard material 11. The resilient material 12 is relatively thin and should have a thickness in the range of one-sixteenth to three-sixteenth of an inch. A thickness of one-eighth of an inch has been found to provide quite satisfactory results.

The resilient material 12 is an elastic material which springs back to its original form after being struck by a drum stick. A suitable form of resilient material is rubber. Pure gum rubber has been found to provide excellent results.

The drum practice pad 10 further includes a plurality of sound insulating cushions affixed to the lower surface of the piece of hard material 11 for supporting the hard material 11 in an acoustically-floating manner when the practice pad 10 is being used. These support cushions may take various forms, depending on the particular manner of use. They may, for example, take the form of a plurality of resilient cushions or pads affixed to the lower surface of the hard material 11. A useful embodiment is shown in FIG. 2 and is comprised of three sound insulating cushions 14, 15 and 16 which are located in a triangular pattern and affixed to the lower surface of the piece of hard material 11 equidistant from the center of the hard material 11. In particular, the center of each of sound insulating cushions 14, 15 and 16 should be located at a distance from the center of the piece of hard material 11 which is equal to approximately two-thirds the radius of the hard material 11. This distance is represented in FIG. 2 by the dimension "d" for the case of cushion 14. This two-thirds distance has be found to provide the best sound quality for the practice pad 10. Each of cushions 14, 15 and 16 is of circular shape and has a diameter of approximately one and one-half inches.

Figure 4:
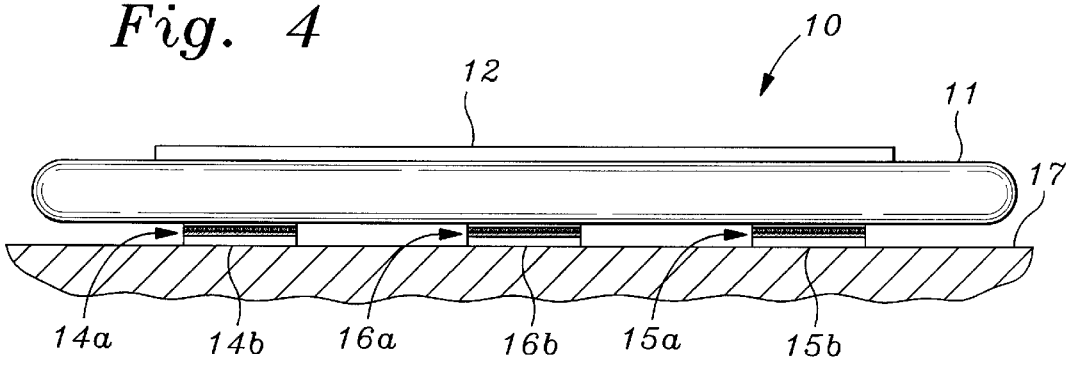

Referring to FIG. 4, there is shown a modified form of construction for the sound insulating cushions 14, 15 and 16. The FIG. 4 modification is intended for use in those cases where the drum practice pad 10 is placed on top of an existing structure 17 during use. Structure 17, only a fragment of which is shown, may be a table or desk or counter top or some other convenient existing structure having a flat upper surface. The three modified cushions of FIG. 4 are designated as 14*a*, 15*a* and 16*a*. They are circular in shape and are of approximately the same diameter as the cushions 14, 15 and 16 shown in FIG. 2. They are affixed to the underside of the piece of hard material 11 in the same locations as shown in FIG. 2 for cushions 14, 15, and 16. As such, the center of each of cushions 14*a*, 15*a* and 16*a* of FIG. 4 is spaced from the center of hard material 11 by a distance equal to two-thirds the radius of the hard material 11.

Each of sound insulating cushions 14*a*, 15*a* and 16*a* of FIG. 4 is of the same construction. Each cushion includes a circular piece of resilient support material which serves as the bottom or foot of the cushion. These bottom pieces of support material are identified as elements 14*b*, 15*b* and 16*b* for the respective ones of cushions 14*a*, 15*a* and 16*a*. For each cushion 14*a*, 15*a* and 16*a*, a first circular layer of Velcro material is bonded to the lower surface of the hard material 11 at the locations 14, 15 and 16 shown in FIG. 2. These first pieces are loop-type Velcro material. A second circular layer of Velcro material is bonded to the upper surface of each bottom piece of support material 14*b*, 15*b* and 16*b*. These second pieces are hook-type Velcro material. Bottom pieces 14*b*, 15*b* and 16*b* are fastened to the piece of hard material 11 by pressing their Velcro layers into engagement with the Velcro layers bonded to the lower surface of hard material 11. This Velcro attachment mechanism enables the bottom pieces 14*b*, 15*b* and 16*b* to be readily removed when it is desired to use some other form of support, such as the one shown in FIGS. 5–7, for the drum pad 10.

When using a table top or other existing structure to support the drum practice pad 10, the best sound is obtained when the piece of hard material 11 is not in direct contact with the table top or other structure. A non-rigid separation is accomplished by the use of the resilient sound insulating cushions 14*a*, 15*a*, and 16*a* shown in FIG. 4. This non-rigid separation enables the piece of hard material 11 to acoustically float and thereby to resonate or vibrate without significant hindrance or undesired side effects. Rubber has been found to be a suitable material for the bottom pieces 14*b*, 15*b*, and 16*b* of the support members 14*a*, 15*a* and 16*a*. This plus the Velcro layers provides the desired floating action.

Figure 5:
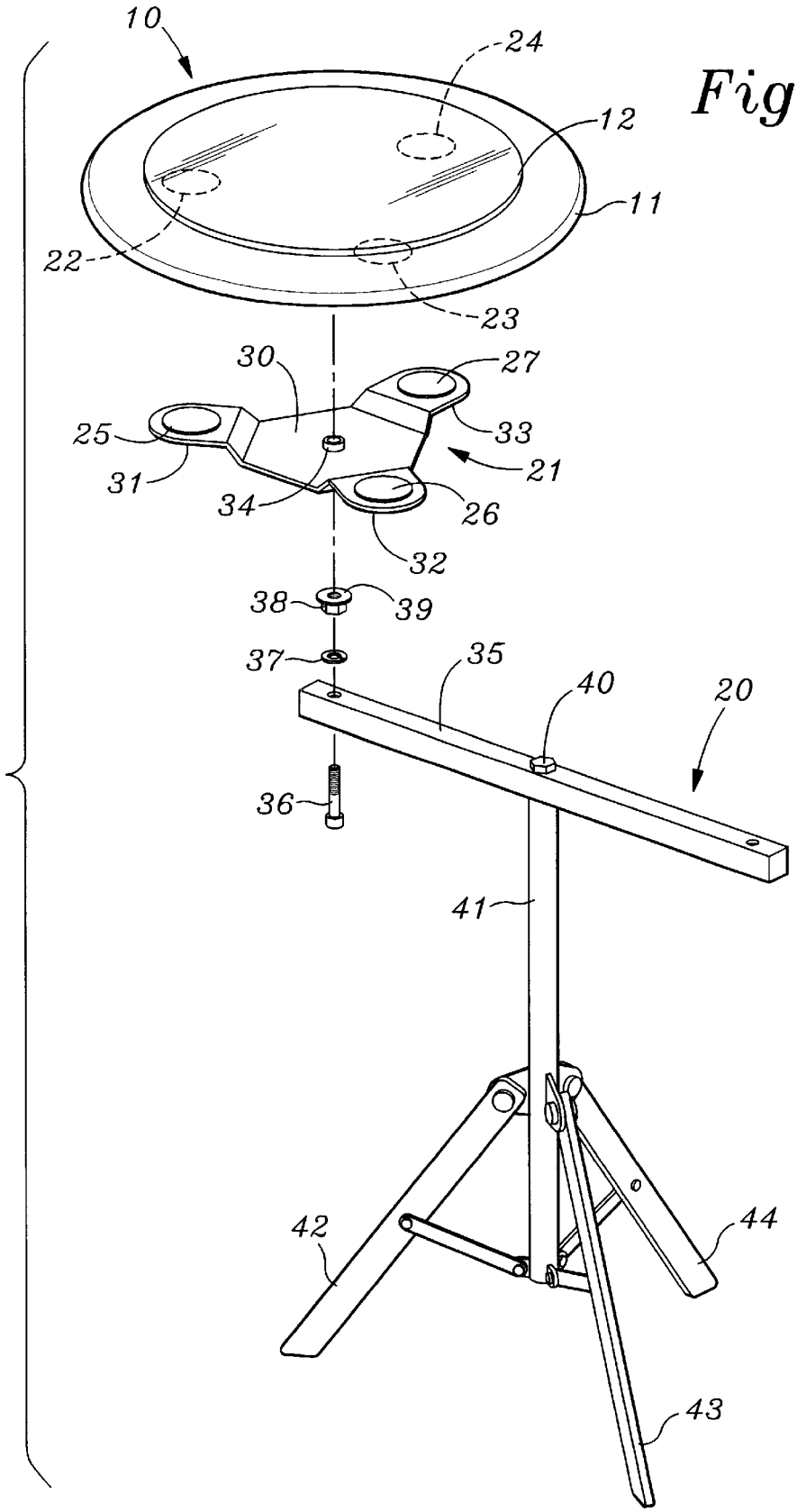
FIG. 5 is an exploded view showing the mounting of the drum practice pad of FIG. 1 on a support stand.

Referring now to FIG. 5, there is shown an exploded view showing the mounting of the drum practice pad 10 on a support stand 20, which may be similar in construction to a music support stand or cymbal stand. An attachment assembly includes a metal support member 21 and a non-rigid mechanism for attaching the piece of hard material 11 of the practice pad 10 to the metal support member 21. The non-rigid mechanism is comprised of a plurality of loop-type Velcro pads 22, 23 and 24 which are bonded to the lower surface of the hard material 11 and a plurality of hook-type Velcro pads 25, 26 and 27 which are bonded to the metal support member 21 for mating with the first plurality of Velcro pads 22, 23 and 24 and thereby attaching the practice pad hard material 11 to the metal support member 21. Velcro pads 22, 23 and 24 are positioned at the same locations as shown in FIG. 2 for the cushions 14, 15 and 16. Velcro pads 22, 23 and 24 are bonded to the drum pad hard material 11 by an appropriate glue material. Mating Velcro pads 25, 26 and 27 are bonded to the metal support member 21 by an appropriate glue material.

The metal support member 21 is comprised of a metal plate member 30 having a plurality of raised shoulder portions 31, 32 and 33 which are individually aligned with different ones of the plurality of Velcro pads 22, 23 and 24 affixed to the lower surface of the drum pad hard material 11. The second plurality of Velcro pads 25, 26 and 27 are individually glued to the upper surfaces of the different ones of the raised shoulder portions 31, 32 and 33. An internally-threaded nut 34 is affixed to the upper side of the metal plate member 30 in alignment with a hole drilled through the center of the plate member 30.

In use, the metal support member 21 is attached to a horizontal cross-bar 35 of the support stand 20 by means of a threaded bolt 36 which passes through a hole drilled through the cross-bar 35 near the end thereof. Bolt 36 threads into the nut 34 to hold the support member 21 in place on the cross-bar 35. A washer 37, a nut 38 and a second washer 39 are located on the bolt 36 intermediate cross-bar 35 and support member 21 for providing a bit of a pedestal for the support member 21. Nut 38 also serves to keep the bolt 36 in place when the support member 21 is removed from the cross-bar 35. Cross-bar 35 is attached to the main body of the support stand 20 by a bolt 40. Support stand 20 includes a vertical support shaft 41 having attached to the lower end thereof a set of retractable support legs 42, 43 and 44.

Figure 6:
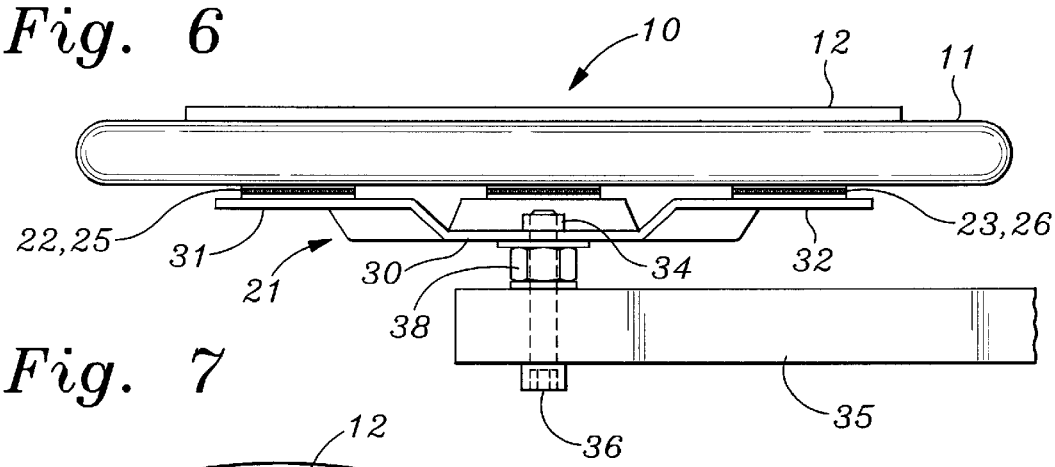
FIG. 6 is a side view showing the drum practice pad mounted on the cross-bar of the support stand of FIG. 5.

FIG. 6 is a side view showing the drum pad 10 mounted on the cross-bar 35 of the support stand 20. Interlocking Velcro pads 22, 23, 24 and 25, 26, 27 attach the drum pad 10 to the metal support member 21. Bolt 36 and nut 34, in turn, attach support member 21 to the cross-bar 35. Velcro pads 22, 23, 24 and 25,26, 27 provide a resilient, non-rigid mechanism for attaching the drum pad 10 to the support stand 20. This provides good sound quality with a minimum of damping or distortion of the vibrations of the drum pad hard material 11. In this regard, the upper end of mounting bolt 36 must be clear of and must not contact the underside of the drum pad hard material 11.

Figure 7:
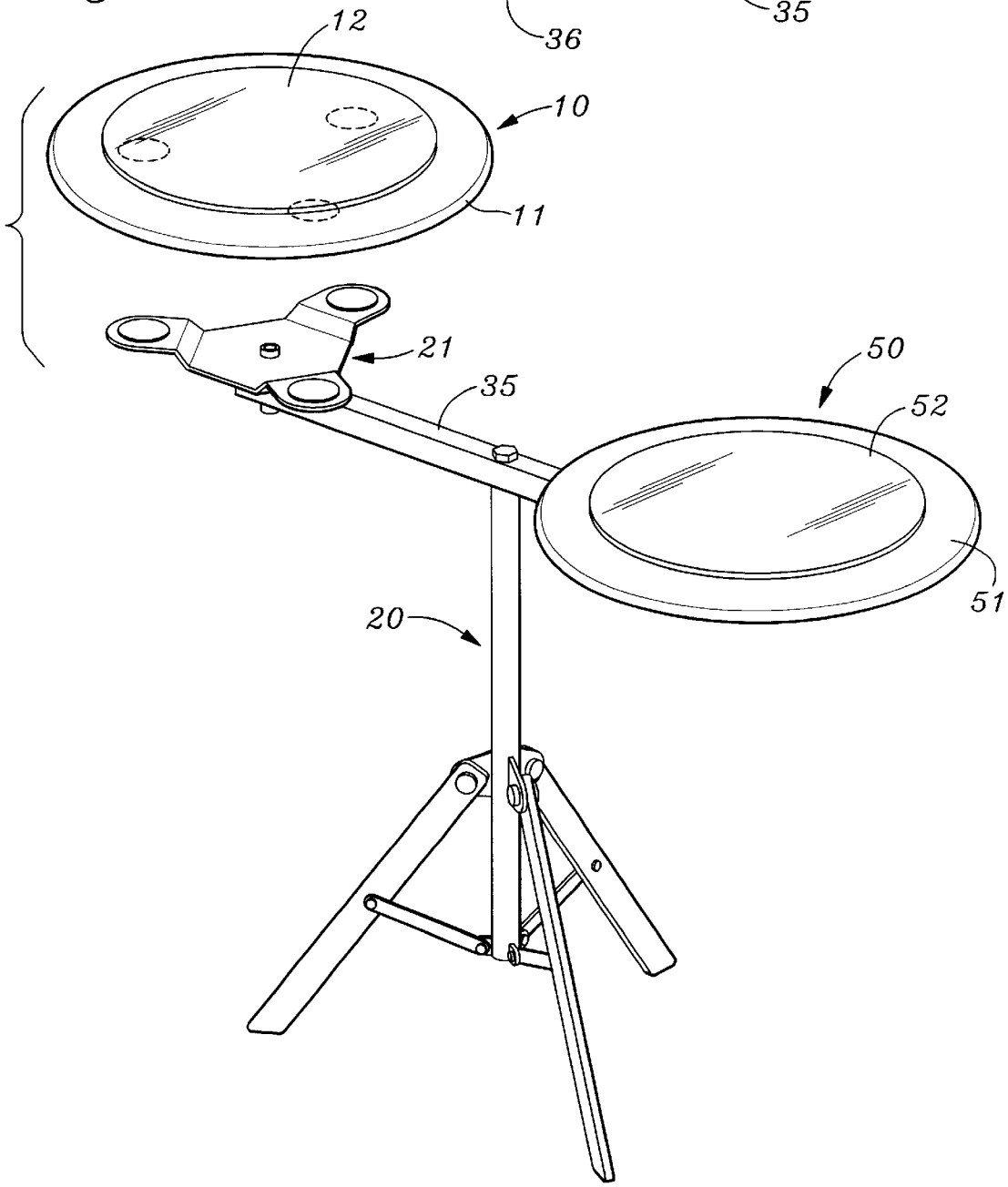
FIG. 7 shows a pair of drum practice pads mounted on the support stand of FIG. 5.

Referring now to FIG. 7, there is shown a pair of drum pads 10 and 50 mounted on the cross-bar 35 at opposite ends thereof. With one importance difference, the second drum pad 50 is of the same construction as the previously discussed drum pad 10. In particular, the second drum pad 50 is comprised of a flat circular piece of hard material 51 having a flat circular piece of resilient material 52 bonded to the upper surface of the hard material 51. Drum pad 50 is connected to the cross-bar 35 in the same manner as described above for drum pad 10. As such, it has a metal support member (not visible) which is attached to the underside of the hard material 51 by a resilient attachment mechanism comprised of Velcro pads which are located in the same manner as the Velcro pads of the first drum pad 10. As with pad 10, the preferred material for hard material 51 is wood and the preferred material for resilient material 52 is rubber.

The important difference between drum pads 10 and 50 is that the hard material 51 of drum pad 50 has at least one dimension which is different from the corresponding dimension of the hard material 11 of drum pad 10. This dimension may be either the thickness of the hard material 51 or the diameter of the hard material 51. Or both dimensions may be different. This difference causes the second drum pad 50 to produce sound of a different pitch from that produced by drum pad 10 when struck by a drum stick. The thicker the hard material, the higher the pitch. The smaller the diameter of the hard material, the higher the pitch.

By using two drum pads with different dimensions, there is provided a plural-pitch set of drum pads which is capable of producing a recognizable two pitch (plural pitch) sound pattern. As such, the combination of different pitch drum pads can be thought of as a new type of drum-like musical instrument. More than two different pitch drum pads can, of course, be provided to provide a multiple pitch set of drum pads.

There will now be given an example of drum pad constructions that have been found to produce desirable results. In this example, each piece of hard material 11 and 51 is made of laminated maple wood. Each piece of hard material 11 and 51 has a diameter of twelve inches. One piece of hard material has a thickness of one-half inch (e.g., seven-ply maple) and the other piece of hard material has a thickness of three-quarters of an inch (e. g., thirteen-ply maple). Each piece of resilient material 12 and 52 is made of pure gum rubber and each has a diameter of nine and one-half inches and a thickness of one-eighth of an inch. These dimensions were found to produce sounds of two distinctively different pitches which blended quite well together.

The use of the Velcro pads for attaching the drum pads to their metal support members has several advantages. For one thing, it enables the drum pad set to be quickly disassembled for storage or transportation purposes. Another advantage is that it enables the drum pads to be quickly converted to the table top configuration of FIG. 4. When traveling, it may be desirable to carry only the drum pads with the small resilient support feet, like those shown in FIG. 4.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

What is claimed is:

1. A drum practice pad comprising:

a flat piece of hard material having planar upper and lower surfaces;

a layer of resilient material directly affixed to the upper surface of the hard material;

and a plurality of small separate sound insulating support cushions affixed to the lower surface of the hard material and spaced apart from one another for supporting the hard material in an acoustically-floating manner during use.

2. A drum practice pad in accordance with claim 1 wherein the piece of hard material is a flat circular piece of hard material.

3. A drum practice pad in accordance with claim 2 wherein the layer of resilient material is a flat circular layer of resilient material having a diameter which is less than the diameter of the flat circular piece of hard material.

4. A drum practice pad in accordance with claim 3 wherein the flat circular layer of resilient material has a diameter in the range of seventy to eighty-five percent of the diameter of the flat circular piece of hard material.

5. A drum practice pad in accordance with claim 3 wherein the flat circular layer of resilient material has a diameter which is on the order of two to three inches less than the diameter of the flat circular piece of hard material.

6. A drum practice pad in accordance with claim 1 wherein the piece of hard material is an acoustically solid piece of hard material.

7. A drum practice pad in accordance with claim 1 wherein the piece of hard material is a non-acoustically-damping piece of hard material.

8. A drum practice pad in accordance with claim 1 wherein the piece of hard material is a solid piece of wood.

9. A drum practice pad in accordance with claim 8 wherein the wood is maple.

10. A drum practice pad in accordance with claim 1 wherein the hard material is laminated wood, each lamination being natural wood.

11. A drum practice pad in accordance with claim 10 wherein each lamination is solid maple.

12. A drum practice pad in accordance with claim 10 wherein the laminated wood is Apple-ply plywood.

13. A drum practice pad in accordance with claim 1 wherein the resilient material is rubber material.

14. A drum practice pad in accordance with claim 1 wherein the resilient material is pure gum rubber.

15. A drum practice pad in accordance with claim 1 wherein:

the piece of hard material is a flat circular piece of natural wood;

and the layer of resilient material is a thin flat circular layer of rubber material bonded to the upper surface of the piece of wood and having a diameter which is less than the diameter of the piece of wood.

16. A drum practice pad in accordance with claim 1 wherein the sound insulating support cushions are comprised of a plurality of separate sound insulating support cushions affixed to the lower surface of the hard material and spaced apart from one another and from both the outer edge and the center of the lower surface of the hard material.

17. A drum practice pad in accordance with claim 16 wherein each sound insulating support cushion includes a layer of Velcro material which is bonded to the lower surface of the piece of hard material.

18. A drum practice pad in accordance with claim 16 wherein each sound insulating support cushion includes:

a first layer of Velcro material which is bonded to the lower surface of the piece of hard material;

a resilient support pad;

and a second layer of Velcro material bonded to the upper surface of the resilient support pad for attaching the resilient support pad to the first layer of Velcro material.

19. A drum practice pad in accordance with claim 1 and including three sound insulating cushions affixed to the lower surface of the hard material and located in a triangular pattern on the lower surface of the hard material.

20. A drum practice pad in accordance with claim 1 wherein:

the piece of hard material is a flat circular piece of hard material;

and the sound insulating cushions include three sound insulating cushions located in a triangular pattern and affixed to the lower surface of the flat circular piece of hard material equidistant from the center of the hard material.

21. A drum practice pad in accordance with claim 20 wherein the center of each sound insulating cushion is located at a distance from the center of the hard material which is equal to approximately two-thirds the radius of the hard material.

22. A drum practice pad in accordance with claim 21 wherein each sound insulating cushion is circular and is approximately one and one-half inches in diameter.

23. A drum pad assembly comprising:

a flat piece of hard material having upper and lower surfaces;

a layer of resilient material affixed to the upper surface of the hard material;

a metal support member;

a non-rigid mechanism for attaching the lower surface of the piece of hard material to the metal support member for providing an acoustically-floating connection there between;

the non-rigid mechanism including a first plurality of Velcro pads affixed to the lower surface of the piece of hard material;

the metal support member including a metal plate member having a plurality of raised shoulder portions aligned with the first plurality of Velcro pads;

and the non-rigid mechanism including a second plurality of Velcro pads affixed to the raised shoulder portions for mating with the first plurality of Velcro pads and attaching the piece of hard material to the metal support member.

24. A drum pad assembly comprising:

a flat piece of hard material having upper and lower surfaces;

a layer of resilient material affixed to the upper surface of the hard material;

a metal support member;

a non-rigid mechanism for attaching the lower surface of the piece of hard material to the metal support member for providing an acoustically-floating connection there between;

the piece of hard material being a flat circular piece of wood;

the piece of resilient material being a flat circular piece of rubber material bonded to the upper surface of the piece of wood;

the non-rigid mechanism including three resilient attachment pads located in a triangular pattern on the lower surface of the piece of wood;

and the metal support member including a metal plate member having three raised shoulder portions for mating with and attachment to the three resilient attachment pads.

25. A drum pad assembly in accordance with claim 24 and including a support stand for attachment to the metal support member for supporting the flat circular piece of wood at a comfortable playing height for the user.

* * * * *